United States Patent [19]

Fraula et al.

[11] 4,280,520

[45] Jul. 28, 1981

[54] WAREWASHING MACHINE SPLASHOVER RETURN SYSTEM

[75] Inventors: Louis F. Fraula, Troy; William H. McMahon, Ludlow Falls; Thomas B. Heckman, Troy, all of Ohio

[73] Assignee: Hobart Corporation, Troy, Ohio

[21] Appl. No.: 74,650

[22] Filed: Sep. 12, 1979

[51] Int. Cl.[3] ..... B08B 3/02

[52] U.S. Cl. ..... 134/60; 134/72; 134/104; 134/154

[58] Field of Search ..... 134/60, 72–73, 134/82, 104, 154, 182–183

[56] References Cited

U.S. PATENT DOCUMENTS

| | | | |
|---|---|---|---|
| 1,664,637 | 4/1928 | Merseles et al. | 134/72 |
| 2,988,094 | 6/1961 | Ludwick et al. | 134/72 |
| 3,363,636 | 1/1968 | Weihe, Jr. | 134/72 |

FOREIGN PATENT DOCUMENTS

| | | | |
|---|---|---|---|
| 2344146 | 3/1975 | Fed. Rep. of Germany | 134/60 |
| 2347305 | 4/1976 | France | 134/104 |
| 507518 | 4/1976 | U.S.S.R. | 134/73 |

*Primary Examiner*—Robert L. Bleutge

*Attorney, Agent, or Firm*—Biebel, French & Nauman

[57] ABSTRACT

A liquid collection pan in the wash compartment below the opening thereinto from the prewash compartment has a shielded slot directed toward the opening which captures and returns liquid entering the wash compartment from the prewash compartment.

7 Claims, 4 Drawing Figures

WAREWASHING MACHINE SPLASHOVER RETURN SYSTEM

BACKGROUND OF THE INVENTION

This invention relates to warewashing machines, and more particularly to compartmentalized warewashing machines of the type having a conveyor which moves food ware items sequentially through the machine from one compartment to the next. Typically such a machine will have a first prewash compartment in which most of the food soil is removed, a main wash compartment in which the remaining food soil is removed, and a rinse compartment wherein fresh water is sprayed on the food ware items to rinse and sanitize them. According to the conditions and needs at hand (e.g., available space, required capacity, and so forth), more or fewer compartments may be provided. Typically, the bottom of each compartment defines a sump which serves as a tank to hold a washing liquid for that compartment. Likewise, each compartment will have a recirculating system consisting of a pump and spray arms for recirculating and spraying the liquid from its respective sump onto the food ware items as they are moved to that compartment by the warewashing machine conveyor. The final rinse, however, will be a fresh water rinse which is not recirculated.

In a typical warewashing machine, at least some of the fresh water from the final rinse is collected in the immediately preceding wash compartment sump, both to refresh the wash water slightly with fresh water, and to make up for water which may have been lost through transport with ware, splash, etc., thereby assuring that the recirculating pump will have an adequate supply and will not cavitate. However, the amount of make-up water is preferably not too great, because it also dilutes the detergent in the sump, which typically has an overflow drain communicating with the sump next upstream, such as the prewash sump. The overflow drain provides a steady supply of liquid to the prewash sump for substantially the same reasons that rinse water is collected in the main wash sump. Since the largest quantity of food soil debris is removed in the prewash compartment, its liquid tends to be the most soiled. The liquid in each subsequent compartment tends to be cleaner since there is less and less food soil debris to remove at each subsequent washing stage. Thus, the overflow drains cascade the surplus water sequentially from the cleanest sumps to those having the most debris.

It is important that the liquid in each sump have as little food soil debris therein as possible. This is important not, as might be initially thought, for removing the food soil debris from the food ware the mechanical action of striking the dishes with the high pressure liquid will remove the debris whether or not there is debris already suspended in the liquid. Rather, when debris is suspended in the wash liquid some of it tends to redeposit onto the food ware items and must again be rinse off. The more soiled the water, the greater the redeposit. Therefore, the liquid in each compartment is usually strained to reduce the amount of suspended debris therein. However, filtration removes only the larger food soil particles. Minute particles, such as mashed potatoes, gravies, bread stuffs, etc., usually go into suspension and cannot be economically filtered. The use of several distinct washing compartments, therefore, which progressively have less and less suspended food soil debris, is to reduce the amount of redeposited food soil as the food ware items progress through the ware washing machine. The "upstream" cascading of the make-up liquid from one compartment to another is also arranged for the same purpose.

If water and detergent were free and available in unlimited quantities, redeposit would never occur because the liquid would never have to be recirculated. Production machines, of course, must represent a compromise in which the best washing results are sought to be accomplished with the least consumption of water, detergent, energy, space utilization, and so forth. Accordingly, in addition to the features discussed above, many conveyor type warewashing machines have splash curtains which are hung across the openings which separate and connect one compartment from another, to discourage and substantially prevent the liquid spray in one compartment from entering the other. Of course, the curtains must yield to food ware as it is moved therethrough by the conveyor, so in some machines the compartments are separated by a zone which serves as a watershed to return those sprays which evade the curtain. The longer the zone, the better the separation, but also the larger the warewashing machine. Since space is at a premium, especially in commercial applications, and since longer spaces may not be available for such machines in many locations, longer chamber separation zones are a solution with only limited appeal.

When the chambers are adjacent one another, a splash curtain helps but is not a complete solution. Splashover of the spray from one compartment into the next will still occur by rebounding of the liquid from the conveyor drive mechanism, racks and rack tracks (if the food ware items are transported in racks), the food ware items themselves, and even the splash curtains when the food ware items and/or racks push the curtain bottom over into the next compartment as the conveyor moves them therepast. Similarly, flow configurations within a given compartment, perhaps necessitated by overall machine design constraints, may cause liquid to pool at the opening between the compartments, such that some of it will escape into the adjacent compartment beneath the splash curtain.

A need thus remains for a system for use in a warewashing machine which will improve the isolation of the liquid in one compartment from the next while providing for minimum (ideally zero) separation therebetween. By improving the isolation, the make-up liquid required for each compartment and the detergent required for the wash compartments are reduced, not only because less food soil debris will be transported into the compartment from the more soiled compartments upstream, but also because the amount of liquid lost by one compartment to the next will be reduced so that there will be less tendency of the recirculating pump to cavitate, and hence less precautionary make-up liquid will be required. The improved isolation should also be maintained even while food ware items are being transported through the opening from one compartment to the next, and displacing the splash curtain.

SUMMARY OF THE INVENTION

Briefly, the present invention meets the above needs and purposes with a liquid collection pan in the wash compartment of a warewashing machine, at the transfer opening connecting the wash and prewash compartments. In the preferred embodiment, the liquid collecting pan is upwardly open, is positioned against the vertical wall which separates the compartments, and extends entirely across and below the transfer opening. It is also below the warewashing machine conveyor but above the level of the liquid in the wash compartment sump.

The warewashing machine contains, typically, the usual conveyor for moving food ware, which may be transported in racks, sequentially through the prewash compartment, the transfer opening, the wash compartment, a rinse chamber, and out of the warewashing machine. The prewash and wash compartments each have a sump which defines a tank for holding liquid for its respective compartment, and for receiving and collecting liquids which fall to the bottom of the respective compartments after being sprayed onto food ware thereabove.

Each compartment also contains a recirculating pump and spray arms for spraying liquid from its respective sump tank onto the food ware as it is moved therethrough by the conveyor. The final rinse, however, is a fresh water rinse which may be supplied, for example, by a pump which pumps a sanitizing rinse solution through spray arms onto the food ware items just before they exit from the warewashing machine. The rinse solution is then collected in the wash compartment sump to replenish and refresh the liquid therein. Excess liquid in the wash compartment sump is transferred to the prewash compartment sump by an overflow drain having an inlet in the wash compartment sump and an outlet in the prewash compartment sump.

Splash curtains in the warewashing machine are hung across the transfer opening which separates the prewash and wash compartments, across the opening into and out of the warewashing machine, and across the area between the wash compartment and the rinse chamber. The splash curtains perform their usual function of keeping the liquid spray substantially where it belongs. Thus the splash curtain across the transfer opening separates the prewash and wash compartments and substantially prevents liquid spray in one compartment from entering the other. At the same time, however, the splash curtain yields to food ware as it is being moved therethrough by the conveyor.

The liquid collection pan has a shield mounted across its top opposite the vertical wall which separates the prewash and wash compartments. The shield is a flat plate which extends upwardly toward the vertical wall and terminates a short distance therefrom to define a shielded slot over the pan which extends entirely across and is opened upwardly toward the transfer opening. The slot receives liquid directed thereto from the transfer opening, directs it into the pan, and thereby captures it before it can enter the wash compartment sump. The shield shields the pan from liquid directed thereto from the spray arms in the wash compartment, and rejects that liquid so that it falls back into the wash compartment sump. A drip ledge is mounted on the vertical wall above the pan and below the slot to assist in directing liquid which is running down the vertical wall into the pan. Finally, the bottom of the pan has a drain opening which is located and positioned over the inlet to the overflow drain so that the prewash liquid which has been captured by the pan is returned to the prewash compartment sump through the overflow drain. Of course, some liquid from the wash compartment will inevitably be captured by the pan, but the shield limits this to less than the liquid which would otherwise be transferred from the wash compartment sump to the prewash compartment sump through the overflow drain. The invention thus substantially reduces the transfer of food soil debris from the prewash compartment into the wash compartment by capturing the splash water from the prewash compartment and returning it thereto.

It is therefore an object of the present invention to provide a splashover return system which captures and returns liquid improperly entering one compartment from another; which may be positioned immediately adjacent the transfer opening from one compartment into another for capturing and returning the liquid; which may include a liquid collection pan having a shielded slot opened toward the transfer opening and located in the compartment into which the liquid splashes over; which thereby reduces the undesirable transport of food soil debris from one compartment of the warewashing machine to another for improving the washability of the warewashing machine while reducing the net water consumption thereof; and to accomplish the above objects and purposes in a versatile, inexpensive, efficient and trouble free configuration readily suited for use in the widest variety of warewashing machine applications.

Other objects and advantages of the invention will be apparent from the following description, the accompanying drawings and the appended claims.

DESCRIPTION OF THE PREFERRED EMBODIMENT

Figure 1:
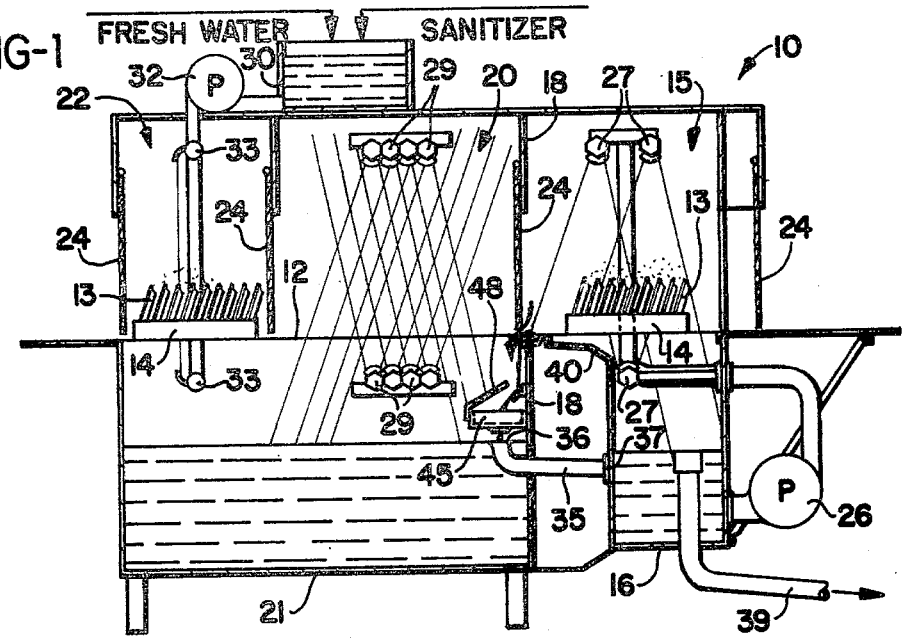
FIG. 1 is a somewhat diagrammatic cross-sectional view of a warewashing machine having a splashover return system according to the present invention.

With reference to the drawings, a warewashing machine 10 has a conveyor 12 which moves food ware items 13 supported in racks 14 through a prewash compartment 15 having a sump 16, then through a transfer opening 17 in a vertical divider wall 18 which divides the prewash compartment 15 from the main wash compartment 20 and its sump 21. Conveyor 12 then moves the racks 14 of food ware items 13 through compartment 20 and into a rinse chamber or zone 22, then out of warewashing machine 10. Splash curtains 24 separate the prewash and wash compartments at the opening 17 in vertical divider wall 18, the wash compartment 20 from the rinse chamber 22, and the inside of the warewashing machine 10 from the outside, at the entrance to the prewash compartment and the exit from the rinse chamber.

The prewash compartment 15 has a recirculating pump 26 which recirculates liquid in sump 16 through spray arms 27 for spraying onto the food ware items as they pass through the compartment. The liquid then falls through compartment 15, returns to and is collected in the sump 16 at the bottom thereof. Similarly, a pump (not shown) recirculates liquid in the wash compartment 20 from its sump 21 and through wash compartment spray arms 29 for washing the food ware items as they are carried therethrough by conveyor 12.

For the final rinse, a rinse system is illustrated in which a chemical sanitizing agent is mixed with fresh water in a rinse solution tank 30, and is pumped on demand by a rinse pump 32 through rinse spray arms 33 onto the food ware items. The rinse solution then falls into and is collected in the wash compartment sump 21. Excess liquid overflows from sump 21 into sump 16 through an overflow drain 35 having an inlet 36 in the wash compartment sump 21 and an outlet 37 in the prewash compartment sump 16. Excess liquid in the prewash compartment sump 16 is similarly drained by an overflow drain 39.

Figure 2:
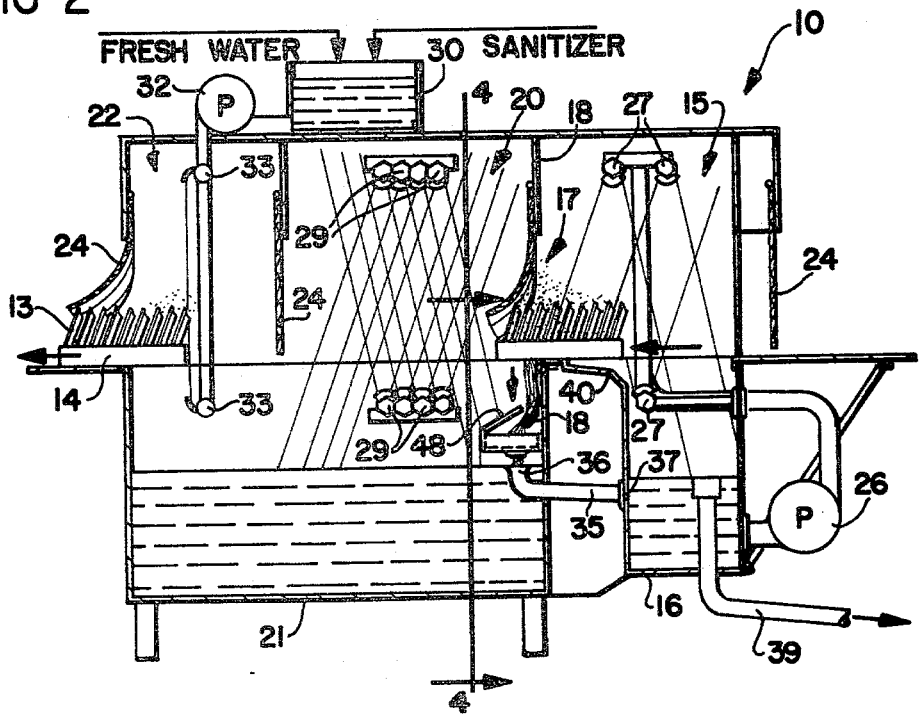
FIG. 2 is a view similar to FIG. 1 showing the food ware supporting racks advancing through the warewashing machine.

Warewashing machine 10 is of a design which has an essentially zero separation between the prewash compartment 15 and the main wash compartment 20. That is, the food ware items are carried directly from one to the other, and they are separated by a single vertical divider wall 18. This maximizes the opportunity for liquid to escape from the prewash compartment into the wash compartment through the transfer opening 17, as when the food ware items and racks are transferred from one compartment to the next. Design constraints sometimes aggravate the problem. For example, warewashing machine 10 illustrates a type of machine in which the prewash compartment 15 includes a shelf 40, at transfer opening 17, which extends downwardly away therefrom. Structures such as shelf 40 are used in some machines to provide space therebeneath for certain machine components. However, when large volumes of liquid are directed onto shelf 40, the liquid sometimes accumulates to a depth that some will spill through transfer opening 17 into wash compartment 20 before it has a chance to flow down shelf 40 back into sump 16. Undesirable transfer of the prewash compartment liquid to the wash compartment also occurs, as shown in FIG. 2, when the racks 14 and food ware items pass through the transfer opening and push the splash curtain 24 aside.

Figure 3:
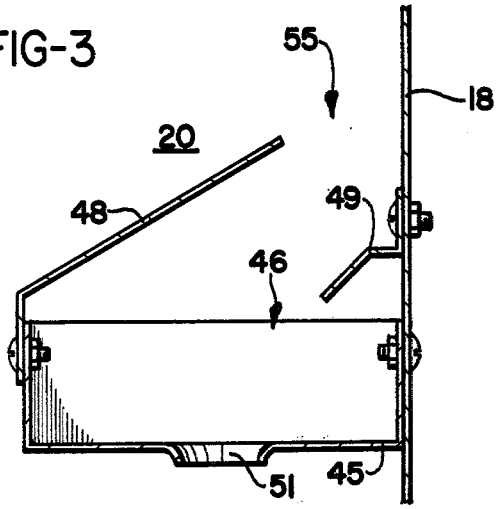
FIG. 3 is an enlarged cross-sectional view of the splashover collection pan taken generally on line 3—3 in FIG. 4.
Figure 4:
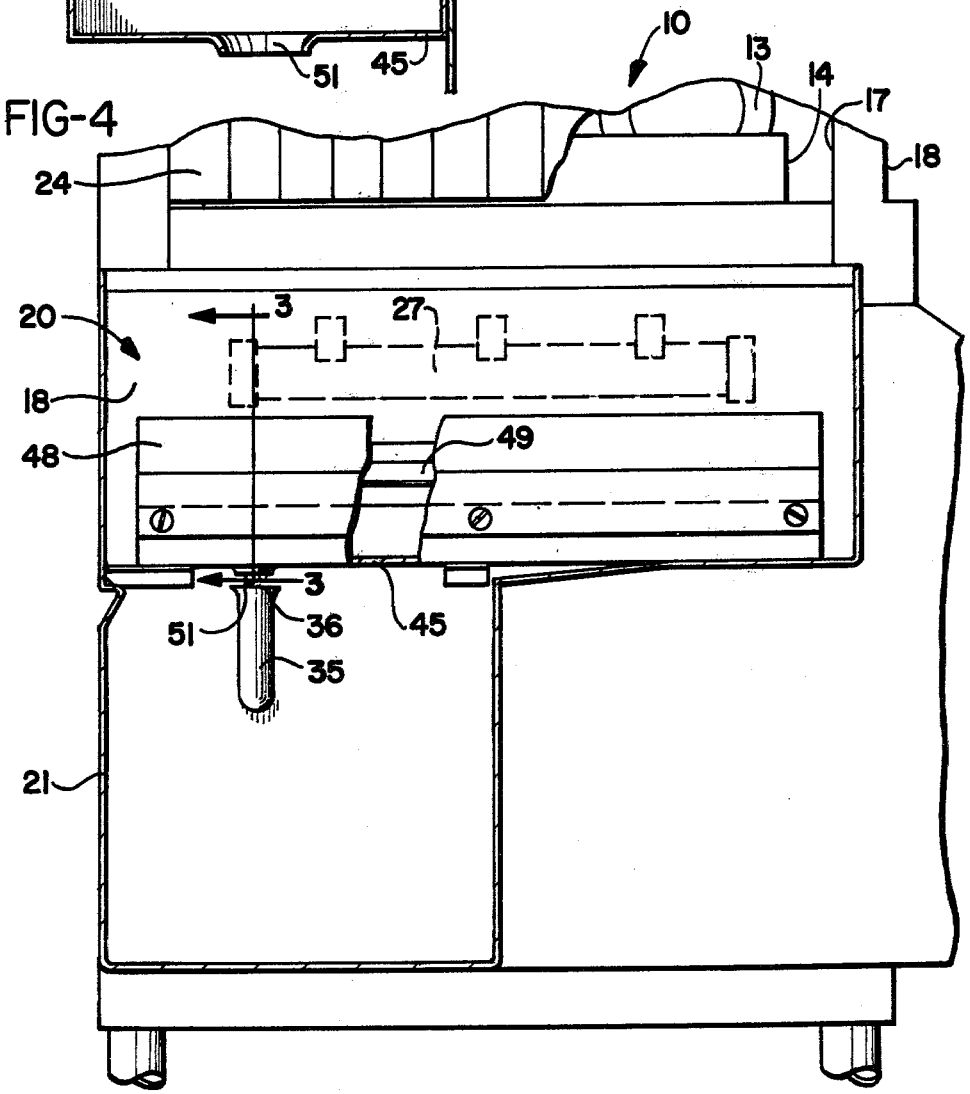
FIG. 4 is a partially broken-away cross-sectional view taken on line 4—4 of FIG. 2.

The present invention therefore includes a pan 45 positioned against the vertical divider wall 18 in the wash compartment 20. Pan 45 is below the transfer opening 17, below the conveyor 12, and above the liquid in the wash compartment sump 21. Pan 45 is upwardly open, with the open top 46 thereof extending entirely across the transfer opening 17 (FIG. 4). A shield 48 is mounted on the top of pan 45 opposite, and extending upwardly at an angle toward, wall 18. Shield 48 terminates a short distance from wall 18 to define a shielded slot 55 (FIG. 3) over pan 45. Slot 55 extends entirely across and is opened upwardly toward the transfer opening 17 for receiving liquid directed thereto from the transfer opening as it escapes from the prewash compartment 15 (FIGS. 1 and 2). A drip ledge 49 may be mounted on the vertical wall 18 above pan 45 and below slot 55 to direct liquid which is running down wall 18 into pan 45. Slot 55 thus directs the liquid into pan 45, where it is captured before it can enter the wash compartment sump 21. Shield 48, being angled essentially "broadside" to the liquid spray coming from the wash compartment spray arms 29 (FIGS. 1 and 2) shields the open top 46 of pan 45 from that spray. The shield 48 rejects the spray from the wash compartment arms so that that liquid is returned to the wash compartment sump 21.

The liquid which is collected by pan 45 is then returned to the prewash compartment 15 through a drain opening 51 in the bottom of pan 45. Drain opening 51 is positioned directly over the inlet 36 to the overflow drain 35 so that the captured liquid is conducted directly back into the prewash compartment sump 16. This prevents food soil in the captured prewash liquid from the entering the wash compartment sump.

As may be seen, therefore, the present invention has numerous advantages. Principally, it will improve the washability of virtually any compartmented warewasher which has less than an infinite separation between compartments. By forming shield 48 to meet the particular machine configuration at hand, it is possible to aim or "point" the slot 55 toward the splashover flow and away from the "legitimate" spray in the wash compartment. Unlike previous efforts to control the splashover, therefore, the present invention is not restricted to devices operating within or at the border of the prewash compartment, but actually goes into the next compartment to capture the splashover which escapes into it and return it to the compartment in which it belongs. Shield 48 makes this feasible notwithstanding the substantial spray volume in the next (wash) compartment. The small amount of (legitimate) liquid captured therefrom is inconsequential due to the overflow drain liquid replenishment system operated concurrently therewith. Similarly, where additional compartments are used in a warewashing machine, additional splashover return systems may be used for improving the isolation of the liquids therebetween. Another advantage of the present invention is that, by improving the washability of the warewashing machine, its water and detergent consumption can be reduced, with corresponding cost and energy savings. Also, chamber separation zones can be eliminated so that warewashing machines with shorter dimensions can be constructed.

While the apparatus herein described, constitutes a preferred embodiment of the invention, it is to be understood that the invention is not limited thereto, and that changes may be made therein without departing from the scope of the invention.

What is claimed is:

1. In a warewashing machine having first and second adjacent compartments, means including a transfer opening connecting the compartments for moving food ware sequentially therethrough, a tank for each compartment for holding liquid for that compartment, spray means for each compartment for spraying liquid from its respective tank onto the food ware therein, and means for returning liquid which falls to the bottom of each compartment to its respective tank, the improvement comprising:

a. liquid collection means positioned in one of said compartments immediately adjacent said transfer opening for capturing liquid entering said one compartment through said opening from the other compartment, said liquid collection means comprising means defining a pan having a shielded slot opened toward said transfer opening for capturing liquid directed thereto from said other compartment through said transfer opening while substantially shielded from the spray means of said one compartment for rejecting liquid directed thereto from the spray means in said one compartment, and b. liquid return means for returning the captured liquid to said other compartment.

2. The improvement of claim 1 wherein the warewashing machine further comprises a substantially vertical wall between the compartments, said transfer opening being in and through said wall, and wherein said liquid collection means is mounted along said wall beneath said transfer opening for capturing liquid running down said wall as well as liquid in the air.

3. The improvement of claim 1 wherein said slot is located and extends substantially entirely across the bottom of said transfer opening.

4. In a warewashing machine having first and second adjacent compartments, means including a transfer opening connecting the compartments for moving food ware sequentially therethrough, a tank for each compartment for holding liquid for that compartment, spray means for each compartment for spraying liquid from its respective tank onto the food ware therein, and means for returning liquid which falls to the bottom of each compartment to its respective tank, the improvement comprising:

a. an upwardly open liquid collection pan positioned in one of said compartments immediately adjacent said transfer opening for capturing liquid entering said one compartment through said opening from the other compartment, b. a shield mounted across the top of said pan for shielding the open pan from and substantially rejecting liquid directed thereto from the spray means in said one compartment, and c. liquid return means for returning the captured liquid to said other compartment, said liquid return means including means defining a drain opening in the bottom of said pan, and a conduit for conducting liquid from said drain opening to the tank of said other compartment.

5. The improvement of claim 4 wherein said conduit further comprises an overflow drain from the tank of said one compartment to the tank of said other.

6. In a warewashing machine including adjacently positioned prewash and wash compartments, means defining an opening between said compartments, a conveyor for moving food ware through said prewash compartment, through said opening, and through said wash compartment, spray means in each compartment for spraying liquid on food ware within said each compartment, a sump tank in each compartment located below said conveyor and said respective spray means for receiving the liquid sprayed on the food ware in its respective compartment, and closure means disposed at said opening between said compartments for normally at least partially closing said opening so as substantially to prevent liquid spray in one compartment from entering the other compartment, said closure means being displaceable for allowing passage of food ware through said opening, the improvement which comprises:

a. liquid collection means disposed in said wash compartment sump tank below said conveyor and adjacent said opening between said compartments for collecting, separate from the liquid in said wash compartment sump tank, a substantial portion of any liquid entering said wash compartment through said opening from said prewash compartment, b. means for shielding said liquid collecting means so as to reject liquid sprayed from said spray means located in said wash compartment, and c. means in said warewashing machine separate from said collection means but communicating with said collection means and said prewash sump tank for returning the collected liquid back to said prewash sump tank to prevent soil removed from the food ware with liquid in said prewash compartment from entering said wash compartment sump tank.

7. In a warewashing machine having adjacent prewash and wash compartments, a substantially vertical wall between the compartments and having a transfer opening therethrough, a conveyor for moving food ware sequentially through the prewash compartment, transfer opening, and wash compartment, a sump in each compartment below the conveyor, each sump defining a tank for holding liquid for its respective compartment and for receiving and collecting liquid which falls to the bottom of its respective compartment after being sprayed thereabove onto food ware therein, spray means for each compartment for spraying liquid from its respective tank onto food ware on the conveyor therein, an overflow drain having an inlet in the wash compartment sump and an outlet in the prewash compartment sump, and a splash curtain hung across the transfer opening to separate the compartments and substantially prevent liquid spray in one compartment from entering the other, while yielding to food ware being moved therethrough by the conveyor, the improvement comprising:

a. an upwardly open pan in the wash compartment positioned adjacent to the vertical wall across and below the transfer opening, below the conveyor, and above the liquid in the wash compartment sump, b. a shield mounted across the top of said pan opposite the vertical wall, extending upwardly theretoward, and terminating a predetermined distance therefrom to define a shielded slot over said pan extending entirely across and opened upwardly toward the transfer opening for receiving liquid directed thereto from the transfer opening and directing it into the pan to capture the liquid before it can enter the wash compartment sump, and for shielding the pan from and rejecting liquid directed thereto from the spray means in the wash compartment, c. a drip ledge on the vertical wall above said pan and below said slot to direct liquid running down said wall into said pan, and d. means defining a drain opening in the bottom of said pan positioned over the inlet to the overflow drain for returning the captured liquid from said pan to the prewash compartment sump to prevent food soil in the captured prewash compartment liquid from entering the wash compartment sump.

* * * * *